United States Patent [19]

Carneim et al.

[11] 4,326,699

[45] Apr. 27, 1982

[54] OIL-TEMPERING APPARATUS FOR PIPES

[75] Inventors: Wilfried Carneim, Langenfeld; Herbert Hillemanns, Ratingen; Hermann Völlmecke, Mülheim; Hans Ribken, Erkrath; Heinz Schumacher, Ratingen; Kurt Roether, Düsseldorf, all of Fed. Rep. of Germany

[73] Assignee: Mannesmann Aktiengesellschaft, Düsseldorf, Fed. Rep. of Germany

[21] Appl. No.: 180,419

[22] Filed: Aug. 22, 1980

[30] Foreign Application Priority Data

Aug. 30, 1979 [DE] Fed. Rep. of Germany ..... 2935242

[51] Int. Cl.[3] ..... C21D 1/00

[52] U.S. Cl. ..... 266/114; 266/132; 266/133; 266/158; 266/159; 266/271

[58] Field of Search ..... 266/114, 120, 132, 133, 266/144, 158, 159, 259, 262, 263, 271

[56] References Cited

U.S. PATENT DOCUMENTS

| | | | |
|---|---|---|---|
| 3,212,766 | 10/1965 | Heinenberg | 266/133 |
| 3,380,724 | 4/1968 | Cary | 266/133 |
| 3,803,996 | 4/1974 | Marshall | 266/144 |
| 4,120,487 | 10/1978 | Sjogren | 266/158 |
| 4,177,088 | 12/1979 | Pierrel | 266/120 |
| 4,245,820 | 1/1981 | Muryn | 266/158 |

OTHER PUBLICATIONS

The American Heritage Dictionary of the English Language, Houghton Mifflin Co., Boston, 1976, p. 1316.

*Primary Examiner*—L. Dewayne Rutledge
*Assistant Examiner*—John P. Sheehan
*Attorney, Agent, or Firm*—Smyth, Pavitt, Siegemund & Martella

[57] ABSTRACT

Hot pipes are tempered in an oil bath contained in a tapered, covered pan; a flap is temporarily opened for feeding, but closed when oil vapor develops, to be sucked off without contaminating the environment. Pan and cover structure are supplemented to prevent uncontrolled escape of vapor during treatment. Different handling devices for pipes in the interior of the pan are described.

4 Claims, 3 Drawing Figures

OIL-TEMPERING APPARATUS FOR PIPES

BACKGROUND OF THE INVENTION

The present invention relates to the temper treatment, or the like, of pipes or tubes in oil.

In certain instances, hot pipes are tempered by exposure to and immersion in oil. As these pipes traverse the oil bath surface, smoke and vapor develops to a considerable degree. On a large scale, this is a significant source for atmospheric pollution. Moreover, these vapors are greatly flammable; and, on the other hand, vaporized oil precipitates on cooler surfaces around the equipment so that these surfaces are soon covered with an oil film. Thus, this procedure has extensive, undesirable side effects.

Description of the Invention

It is an object of the present invention to improve pipe oil treatment devices of the type referred to above in order to suppress the undesired side effects.

The apparatus and the device include, in accordance with the preferred embodiment of the present invention, an oil pan, preferably of a downwardly tapered configuration; pipes are fed to the pan for loading into the oil-filled interior thereof, there being also means for taking pipes out of the pan. The otherwise open top of the pan is closed, at least in parts, by a cover which includes a flap, to be partially opened when a pipe is fed to and into the pan, but to be tightly closed thereafter. The space above the oil bath level in the pan and the cover and flap is vented through a controlled path that may include a scrubber, or the like. The pipes are handled at the bottom of the pan before being moved up and out. A wall structure extends down from the cover above the main tempering zone, partitioning it in order to capture any residual oil vapor and to permit such vapors to be also sucked from the interior of the pan. Thus, the particular pipe treatment apparatus prevents the uncontrolled escape of oil vapors throughout. More than one pipe may be handled in the bottom part of the pan.

The preferred embodiment of the invention, the objects and features of the invention, and further objects, features and advantages thereof, will be better understood from the following description taken in connection with the accompanying drawings.

DESCRIPTION OF THE INVENTION

Figure 1:
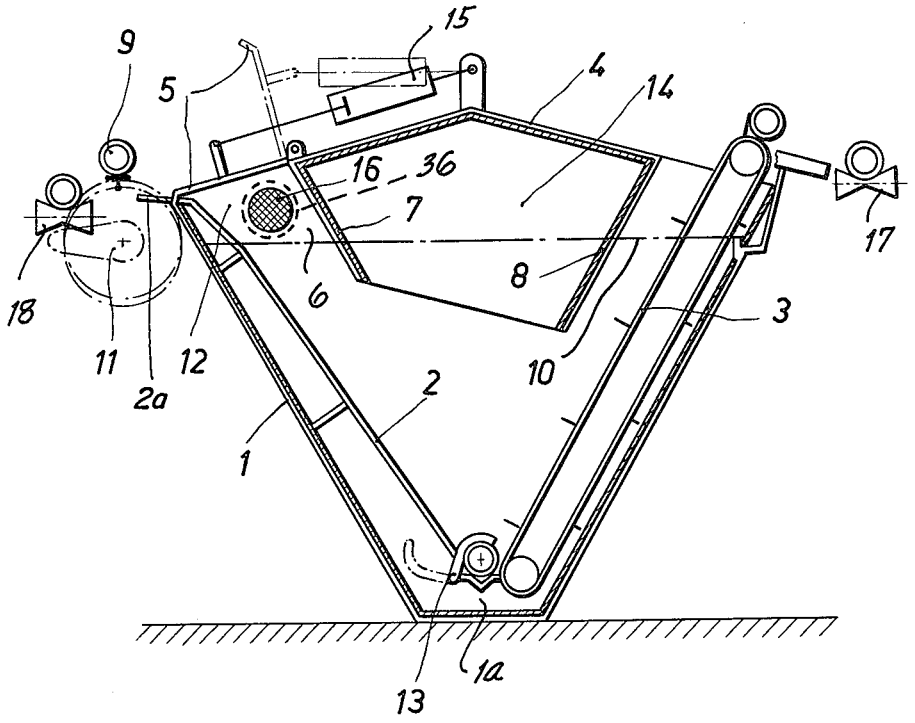
FIG. 1 is a cross section through an apparatus in accordance with the preferred embodiment of the invention for practicing the best mode thereof.

Proceeding now to the detailed description of the drawings, FIG. 1 shows an oil container or pan 1 of downwardly tapering configuration. This pan has, of course, a length dimension transversely to the plane of the drawing which exceeds the length of a pipe or tube to be processed therein.

The pan has a bottom portion 1*a* from which the side walls taper outwardly in an upward direction. The pan has end walls, one of them, end wall 6, being visible above the bath level 10 of oil that fills most of the pan.

The wide top of the pan is covered as to most of the opening by means of a roof-shaped top, lid, or cover 4.

The pan contains a sheet 2 which extends along one of the slanted side walls of the pan and defines a guide path for pipes along that slanted wall toward bottom 1*a*. More or less symmetrically thereto, a conveyor chain 3 is established for taking out/and hoisting tubes or pipes up along the other slanted wall of the pan.

A movable, flap-like cover 5 is disposed between cover 4 and the entrance of the pan, where tubes or pipes 9 arrive for placement into the oil pan. The pipes arrive on a conveyor track 18 and are taken therefrom by a rotatable arm-like transfer device 11, to be placed on sheet extension 2*a* from which the pipe rolls on sheet 2 down into the pan.

An actuator 15 on top 4 is linked to flap 5, to close it when needed. The dash-dot lines indicate flap and actuator in a fully open position. During operation, however, the flap may be opened only to the extent needed to clear a passage for the respective next pipe 9.

The cover 4 is provided with particularly oriented, inwardly extending walls 7 and 8, extending along the paths of the pipes in the pan. Wall 7 is shorter than wall 8, but both dip into the oil whose surface level is indicated by bath level 10. Accordingly, an enclosed space 14 is defined between the walls or partitions 7 and 8, the cover 4, and oil bath level 10.

A clamping device 13 is provided near the bottom of the pan. Generally speaking, this device 13 is a handling device for a pipe after it has arrived in the zone above pan bottom 10*a*. The device 13 includes swing-away arms for clampingly holding the pipe. Upon release, the pipe can be gripped by the conveyor 3 and moved up. In particular, following processing by flushing oil all around the pipe by means of nozzles (not shown; conventional), the conveyor 3 moves the pipe up for placement on another track, 17. The cover 4 does not extend across the exit path, nor is a flap provided here because vapors will not develop at that point. Of course, a movable flap could also be provided if deemed necessary.

Reference numeral 16 refers to a grid-covered opening in the visible front end wall 6 of the pan. As stated, there is a similar wall at the other end, and that wall has also such an opening. The opening 16 (and the other one) opens to the space 12 which is defined by the bath level 10, the unsubmerged portion of the wall 7, cover or flap 5, and the upper part of sheet 2. Opening 16 serves as a venting outlet through which a suction pump 36 sucks any vapor from space 12. The companion opening in the other end wall serves as entrance for fresh air. The vapors, as sucked out of that space, are fed to and through a scrubber, a filter, and/or an afterburner.

The apparatus operates as follows. Hot pipes 9 arrive on track 18 and are transferred by device 11 toward the opening established by the folded-up flap 5. The flap needs to be opened only to the extent that an opening is needed for the pipe 9 in order to roll in. As soon as that has occurred, flap 5 is closed air-tight. The hot pipe hits the surface of the oil path and is immersed. Vapors develop in the space 12, but are sucked off through opening 16.

Additional vapors may develop by the oil as it heats up in the course of processing many pipes, but these vapors will be collected in chamber 14 and recondensate. Should the pressure of evaporated oil become too large, a venting discharge will occur around the shorter wall 7 and into space 12. Following treatment, the pipe is moved up by the conveyor 3 and removed via roller track 17.

It can, thus, be seen that the apparatus, as described, offers significant protection of the immediate and farther environment.

Figure 2:
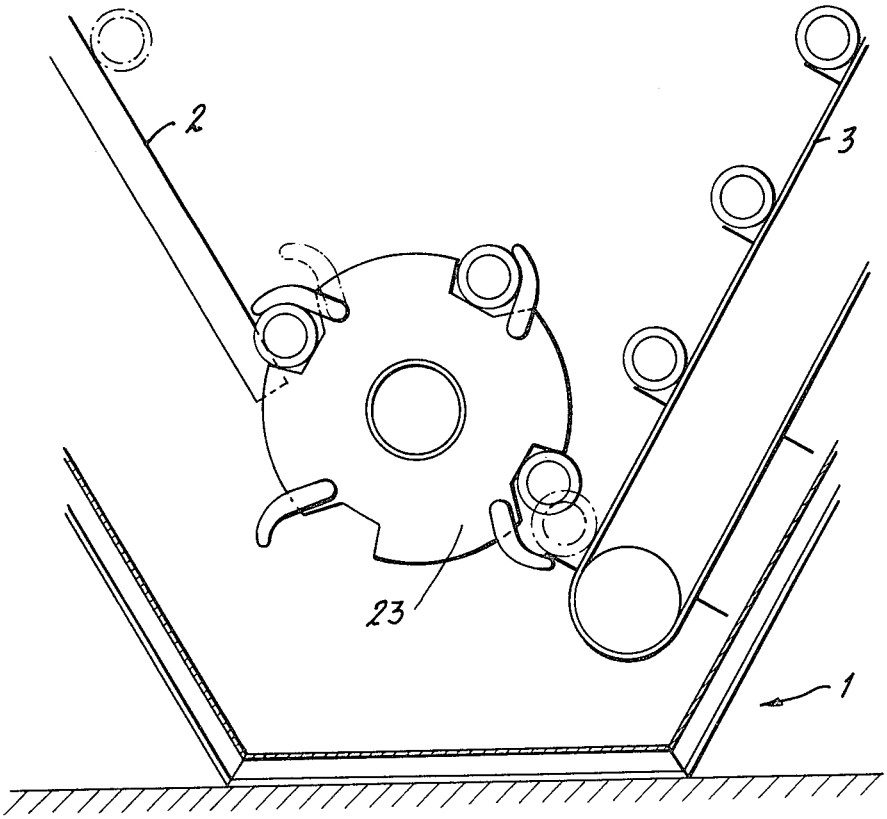
FIG. 2 illustrates, on an enlarged scale, a modified detail of the apparatus shown in FIG. 1 for handling more than one pipe at once.

FIG. 2 illustrates a modification of the handling of pipes in the bottom zone of the pan. One or more handling and holding wheels or drums 23 are provided (i) to receive a pipe that rolls down sheet 2, (ii) move it across in the oil bath; and (iii) deposit it on the next holder in conveyor 3.

Figure 3:
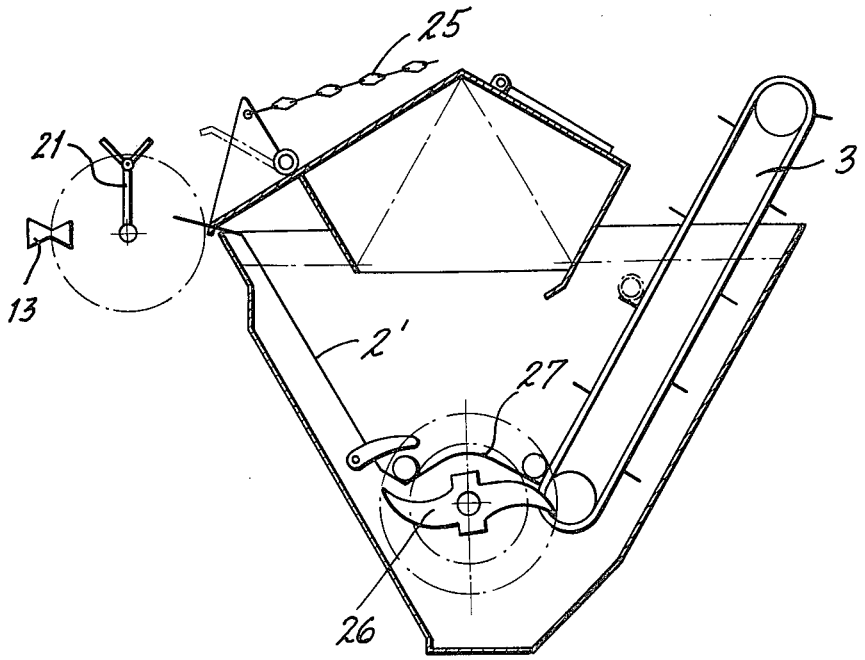
FIG. 3 illustrates, in a view similar to FIG. 1 but under some simplifications, several modifications.

FIG. 3 shows several modifications which can be adopted individually or in combination. The transfer device for pipes at the feed side is constructed here as swing arm in which the pipe rests until being deposited on sheet 2'. The flap 5 in this case is operated via a chain 25 being driven by a suitable winch motor, or the like. The bottom handling device 26 is of an impeller-like construction combined with an upwardly extending bottom part and extension 27 of the feed sheet, denoted here by 2'. The impeller moves the pipes "over the hump, " for them to roll onto the next gripper of conveyor 3.

Selection of the bottom handling device of the pipes will depend upon their weight and on their desired throughput.

The invention is not limited to the embodiments described above; but all changes and modifications thereof, not constituting departures from the spirit and scope of the invention, are intended to be included.

We claim:

1. Apparatus for treating pipes in oil, comprising:

a pan for receiving oil, the pan having a bottom;

means for feeding pipes towards said pan so that the pipes can drop into the pan;

handling means for at least one pipe in the bottom of the pan;

means for taking pipes out of said pan;

a cover on top of said pan having at least a portion constructed as a closable and openable flap, there being means for opening and closing said flap;

said flap having its position in relation to said means for feeding, so that pipes can be fed into the pan when the flap is opened;

partition means extending from the cover in down direction for defining a limited and partially enclosed space above a surface level of an oil bath in the pan, under the flap; and means for sucking vapors from said space under the flap.

2. Apparatus as in claim 1, the pan having a downwardly tapering configuration with inwardly sloping sides and a correspondingly narrow bottom, the means for taking pipes out being disposed and operating along a slanted wall of the pan.

3. Apparatus as in claim 1 or 2, the handling means provided for temporarily holding more than one pipe at the bottom of the pan.

4. Apparatus as in claim 1, the partition means including a first partition closer to the flap than a second partition, the first partition extending less deeply than the second partition, so that pressurized oil vapor that may develop in a space above the oil bath under the cover can escape only into and around the first partition, and into the said space under the flap.

* * * * *